US007959464B2

(12) United States Patent
Mizutani et al.

(10) Patent No.: US 7,959,464 B2
(45) Date of Patent: Jun. 14, 2011

(54) CONNECTOR HAVING WATERPROOF SEALING MEMBER

(75) Inventors: Tatsuhiko Mizutani, Toyota (JP); Hiroshi Kato, Anjo (JP); Hisashi Sawada, Yokkaichi (JP); Kazumoto Konda, Yokkaichi (JP)

(73) Assignees: Toyota Jidosha Kabushiki Kaisha, Aichi-ken (JP); Sumitomo Wiring Systems, Ltd., Mie (JP)

( * ) Notice: Subject to any disclaimer, the term of this patent is extended or adjusted under 35 U.S.C. 154(b) by 83 days.

(21) Appl. No.: 12/514,945

(22) PCT Filed: Apr. 10, 2008

(86) PCT No.: PCT/JP2008/057462

§ 371 (c)(1),
(2), (4) Date: May 14, 2009

(87) PCT Pub. No.: WO2008/130001

PCT Pub. Date: Oct. 30, 2008

(65) Prior Publication Data

US 2010/0075535 A1 Mar. 25, 2010

(30) Foreign Application Priority Data

Apr. 18, 2007 (JP) ..... 2007-108832

(51) Int. Cl.
*H01R 13/40* (2006.01)

(52) U.S. Cl. ..... 439/588; 439/936

(58) Field of Classification Search ..... 439/588, 439/278, 279, 736, 936, 587, 276
See application file for complete search history.

(56) References Cited

U.S. PATENT DOCUMENTS

| | | | | |
|---|---|---|---|---|
| 5,433,628 | A | 7/1995 | Sadaishi et al. | |
| 5,593,320 | A * | 1/1997 | Konda et al. | 439/589 |
| 5,660,555 | A | 8/1997 | Ito et al. | |
| 7,059,904 | B2 * | 6/2006 | Konda | 439/607.04 |
| 2005/0037666 | A1 * | 2/2005 | Konda | 439/607 |

FOREIGN PATENT DOCUMENTS

| | | | |
|---|---|---|---|
| JP | 6-84565 | A | 3/1994 |
| JP | 7-42018 | U | 7/1995 |
| JP | 8-138794 | A | 5/1996 |
| JP | 2007-53105 | A | 3/2007 |

* cited by examiner

*Primary Examiner* — Javaid Nasri
(74) *Attorney, Agent, or Firm* — Sughrue Mion, PLLC

(57) ABSTRACT

A connector (10) comprises a primary resin-molded member (20) integrally covering both a terminal (18) and a covering material (14). A first sealing material (24) is disposed at the first joining portion (28) between the primary resin-molded member (20) and the covering material (14) so as to seal the first joining portion (28). The first sealing material (24) is integrally covered together with the primary resin-molded member (20) by a secondary resin-molded member (22). The peeling of the first sealing material (24) from the first joining portion (28) is suppressed by the secondary resin-molded member (22), whereby the durability of the waterproof structure can be improved.

3 Claims, 2 Drawing Sheets

CONNECTOR HAVING WATERPROOF SEALING MEMBER

TECHNICAL FIELD

The present invention relates to a connector provided at an end of a cable, and in particular, to a waterproof structure of the connector.

BACKGROUND ART

A connector is known which is provided at an end of a cable comprising a conductor and a covering member which covers the conductor, and which electrically connects the cable with another cable or an electric device. The connector comprises a terminal which is connected to the conductor, which is exposed protruding from the covering member, and an electrical connection is achieved by the terminal being connected to a terminal provided on an electric device or another cable to which the cable is to be connected. For purposes of waterproofing and dust-proofing, a connector is known in which the terminal and the portion of the covering member adjacent to the terminal are integrally covered with a molded component made of a resin.

JP Hei 8-138794 A discloses a technique in which a resin-molded component which stores the terminal, and a portion of the cable adjacent to the resin-molded component are covered with another resin-molded component, to achieve a waterproof structure.

DISCLOSURE OF INVENTION

Problem to be Solved by the Invention

In the connector of the related art, water or the like may intrude into the interior of the connector through a gap between the covering member and the resin-molded member from the side of the cable. According to a method to prevent such an intrusion of water or the like, a sealing member is placed at the connection portion between the covering member and the resin-molded member, to thereby seal the connection portion. However, in an application where the cable may be agitated, such as a cable used in a body of an automobile, the cable tends to move with respect to the resin-molded member, and the sealing member may be peeled off from the connection portion, resulting in a problem of a reduction in waterproofing capability.

An advantage of the present invention is provision of a connector which is provided at an end of a cable and which can improve the durability of the waterproof structure, with a simple structure.

Means for Solving the Problem

According to one aspect of the present invention, there is provided a connector which is provided at an end of a cable comprising a conductor and a covering member which covers the conductor, the connector comprising a terminal which is connected to a conductor protruding from the covering member, a primary resin-molded member which integrally covers portions, of the terminal and the covering member, which are adjacent to each other, a first sealing member which is disposed at a connection portion between the primary resin-molded member and the covering member and which seals the connection portion, and a secondary resin-molded member which integrally covers an end of the primary resin-molded member near the covering member and the first sealing member.

According to another aspect of the present invention, preferably, in the connector, the first sealing member comprises a liquid seal material.

According to another aspect of the present invention, preferably, the connector further comprises a second sealing member which is disposed at a connection portion between the secondary resin-molded member and the covering member and which seals the connection portion.

ADVANTAGES

According to the connector of the present invention, there is provided a connector which is provided at an end of a cable and which can improve durability of a waterproof structure, with a simple structure.

EXPLANATION OF REFERENCE NUMERALS

10 CONNECTOR; 12 CABLE; 14 COVERING MEMBER; 16 CONDUCTOR; 18 TERMINAL; 20 PRIMARY RESIN-MOLDED MEMBER; 22 SECONDARY RESIN-MOLDED MEMBER; 24 FIRST SEALING MEMBER; 26 SECOND SEALING MEMBER

BEST MODE FOR CARRYING OUT THE INVENTION

A preferred embodiment of the present invention will now be described with reference to the drawings. A cable which is to be connected to an electric device is exemplified, and a connector which is provided at an end of such a cable will be described. The present invention is not limited to the connector for connection to an electric device, and may be applied to connectors for connection of cables.

Figure 1:
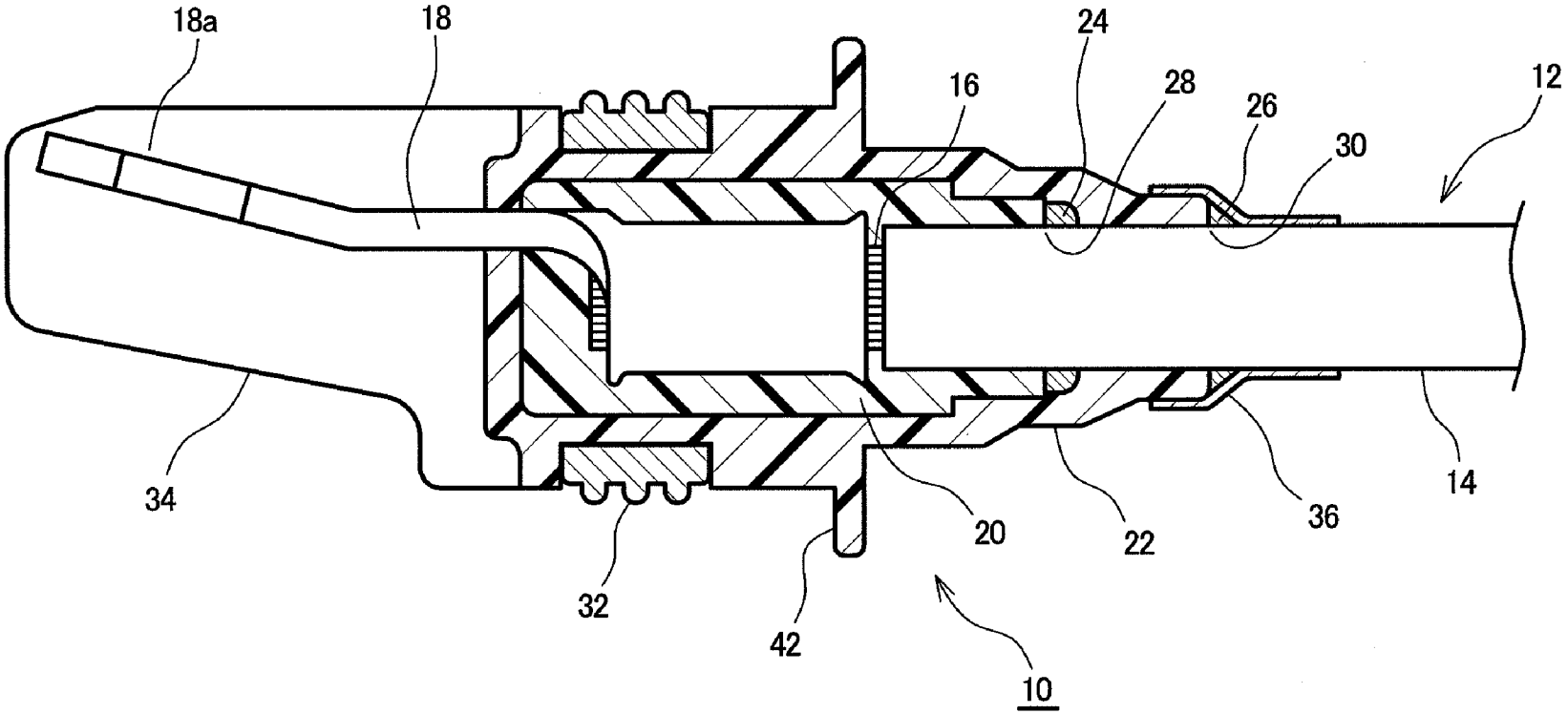
FIG. 1 is a cross sectional view showing a connector according to a preferred embodiment of the present invention.
Figure 2:
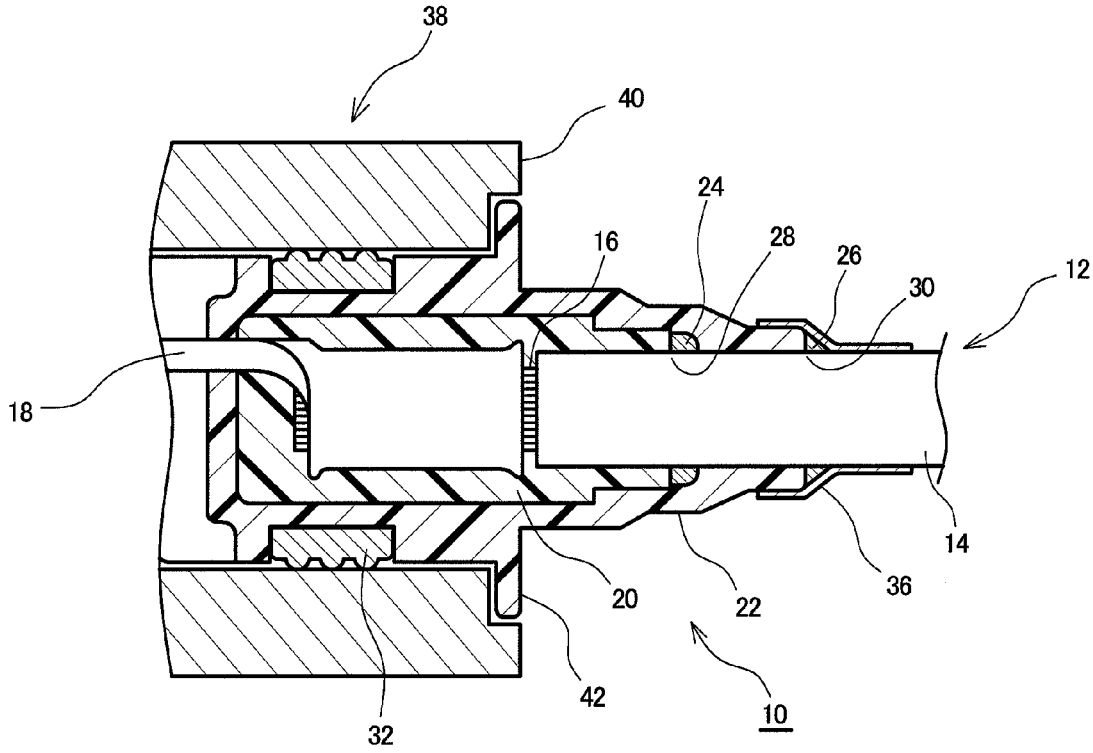
FIG. 2 is a cross sectional view showing a connector fixed on an electric device.

FIG. 1 is a cross sectional view of a connector 10 of a preferred embodiment of the present invention. FIG. 2 is a cross sectional view of a connector 10 fixed on an electric device 38. Although FIG. 1 only shows a structure of the connector 10 provided at one end of the cable 12, the structure at the other end is similar.

The connector 10 is provided on a cable 12 comprising a conductor 16 and a covering member 14 which covers the conductor. The connector 10 comprises a terminal 18 which is connected to the conductor 16 exposed protruding from the covering member 14. A hole 18*a* is formed in the terminal 18 for passing of a bolt (not shown). A bolt is passed through the hole 18*a*, and the terminal 18 and the terminal (not shown) of the electric device 38 are connected by the bolt, to thereby achieve an electrical connection between the cable 12; in particular, the conductor 16, and the electric device 38 through the connector 10.

The connector 10 also comprises a partitioning plate 34 which partitions the terminal 18 and a terminal (not shown) which is placed next to the terminal 18 in a direction of penetrating the page. The partitioning plate 34 comprises a material having an insulating characteristic, and is made of, for example, a resin. With this structure, the insulating distance between the terminal 18 and the terminal adjacent to the terminal 18 can be shortened.

The connector 10 also comprises a primary resin-molded member 20 and a secondary resin-molded member 22 which integrally covers the primary resin-molded member 20. The molded members are molded through injection molding in which an insulating resin is pressured, injected, and filled into a die. The primary resin-molded member 20 integrally covers portions, of the terminal 18 and the covering member 14, which are adjacent to each other, to thereby improve the insulation resistance, waterproofing capability, and dust-proofing capability of these portions. Moreover, the primary resin-molded member 20 covers a portion of the conductor 16 which is exposed and a portion of the terminal 18 connected to the conductor 16. By covering all of the exposed portions of the conductor 16 with the primary resin-molded member 20, it is possible to secure the insulation resistance or the like in the exposed portion of the conductor 16.

At a first connection portion 28 in which the primary resin-molded member 20 and the covering member 14 are connected, a first sealing member 24 for sealing a gap between the primary resin-molded member 20 and the covering member 14 is disposed. The secondary resin-molded member 22 is molded to cover the primary resin-molded member 20 and the first sealing member 24. The first sealing member 24 comprises a liquid seal material having viscosity, such as silicone. The first sealing member 24 closely contacts the secondary rein-molded member 22 and the first connection portion 28 without a gap, by virtue of the adhesion force of the first sealing member 24 and a pressure when the secondary resin-molded member 22 is molded, and seals this portion. With such a structure, it is possible to prevent water, which enters from the side of the cable 12 and through the gap between the covering member 14 and the secondary resin-molded member 22, from intruding further into the inside of the connector 12; that is, the side of the terminal 18.

The secondary resin-molded member 22 comprises a plate-shaped flange section 42 which projects in a radial direction. The flange section 42 is in contact with an end of a housing 40 which stores the terminal of the electric device 38 and is fixed by a clamping part such as a screw (not shown), so that the connector 10 is fixed to the electric device 38. The secondary resin-molded member 22 also has a ring-shaped rubber ring 32 disposed from an outer periphery side of the secondary resin-molded member 22. The rubber ring 32 is fitted with the inner wall of the housing 40 without a gap when the connector 10 is fixed to the electric device 38, and seals the fitted portion. With this structure, it is possible to prevent intrusion of water from the outside through a gap between the housing 40 and the secondary resin-molded member 22.

At a second connection portion 30 in which the secondary resin-molded member 22 and the covering member 14 are connected, a second sealing member 26 which seals the gap between the secondary resin-molded member 22 and the covering member 14 is disposed. The second sealing member 26 comprises, similar to the first sealing member 24, a liquid seal material having viscosity, such as silicone. On the second sealing member 26, a protection tape 36 is wound around an outer periphery of the second sealing member 26, in order to protect the second sealing member 26 from damage caused by contact from the outside. The second sealing member 26 closely contacts the second connection portion 30 without a gap, by virtue of the adhesion force of the second sealing member 26, and seals the second connection portion 30. With this structure, it is possible to prevent intrusion of water from the side of the cable 12 to a gap between the covering member 14 and the secondary resin-molded member 22.

With the connector 10 of the present embodiment, because the secondary resin-molded member 22 integrally covers the primary resin-molded member 20 and the cable 12, it is possible to suppress a relative displacement between the primary resin-molded member 20 and the cable 12. Therefore, even when the cable 12 is used in an application possibly involving agitation, the peeling of the first sealing member 24 from the first connection portion 28 is suppressed, and the durability of the waterproof structure can be improved.

In addition, with the connector 10 of the present embodiment, because a step is formed by the end portion of the primary resin-molded member 20 near the covering member 14 and the covering member 14, the first sealing member 24, which is a liquid seal material having viscosity, can easily be caused to adhere along the step when the first sealing member 24 is disposed in the first connection portion 28.

Moreover, with the connector 10 of the present embodiment, because a double waterproof structure for sealing the intrusion of the water from the side of the cable 12 with the first and second sealing members 24 and 26 is constructed, durability can be improved.

In the above-described preferred embodiment, there has been described a configuration where the first and second sealing members 24 and 26 are liquid seal materials having viscosity, but the present invention is not limited to such a configuration, and, alternatively, a rubber ring may be used.

In the above-described preferred embodiment, there has been described a configuration where the secondary resin-molded member 22 covers the entirety of the primary resin-molded member 20, but the present invention is not limited to such a configuration, and the secondary resin-molded member 22 may be molded partially covering the primary resin-molded member 20, so long as the secondary resin-molded member 22 integrally covers the end of the primary resin-molded member 20 near the covering member 14 and the first sealing member 24.

The invention claimed is:

1. A connector which is provided at an end of a cable comprising a conductor and a covering member which covers the conductor, the connector comprising:

a terminal which is connected to a conductor protruding from the covering member;

a primary resin-molded member which integrally covers portions of the terminal and the covering member which are adjacent to each other;

a first sealing member which is disposed at a first connection portion between the primary resin-molded member and the covering member and which seals the first connection portion; and a secondary resin-molded member which integrally covers an end of the primary resin-molded member near the covering member and the first sealing member.

2. The connector according to claim 1, wherein the first sealing member comprises a liquid seal material.

3. The connector according to claim 1, further comprising a second sealing member which is disposed at a second connection portion between the secondary resin-molded member and the covering member and which seals the second connection portion.

* * * * *